United States Patent [19]

Wnek

[11] 4,026,447

[45] May 31, 1977

[54] COAT HANGER ATTACHMENT

[76] Inventor: Walter Wnek, 6000 Parkland Ave., Suitland, Md. 20028

[22] Filed: Apr. 9, 1976

[21] Appl. No.: 675,522

[52] U.S. Cl. ..... 223/98
[51] Int. Cl.[2] ..... A47J 51/086
[58] Field of Search ..... 223/98, 88

[56] References Cited

UNITED STATES PATENTS

| | | | |
|---|---|---|---|
| 1,740,566 | 12/1929 | Batts | 223/98 X |
| 3,167,224 | 1/1965 | Landers | 223/98 |
| 3,301,447 | 1/1967 | Felton | 223/98 |

*Primary Examiner*—George H. Krizmanich
*Attorney, Agent, or Firm*—Jack D. Slobod

[57] ABSTRACT

A pad attachment for a wire coat hanger includes a tubular collar for receiving the shank of the hook members and the upper portions of the upwardly converging arms of the hanger and an elongated substantially rigid arcuate skirt configured to cover the arms. A pair of spaced apart parallel planar webs within the collar form a guide to prevent the hanger from twisting relative to the pad attachment and a pin passing through the collar and perpendicularly through the webs engages under the apex of the triangular portion of the hanger for capturing the hanger in the attachment.

1 Claim, 3 Drawing Figures

COAT HANGER ATTACHMENT

FIELD OF THE INVENTION

The present invention relates generally to attachments for coat hangers for padding the arms of the hanger. In its particular aspects, the present invention relates to the provision of a collar about the upstanding hook shank and removable pin passing through the collar for capturing the hanger in the attachment.

BACKGROUND OF THE INVENTION

The common wire coat hanger has a tendency to crease clothing because of the relatively small diameter of the upwardly converging arms of the hanger and of the hook support shank which projects upward from the point of intersection of the arms. While it has heretofore been proposed in the prior art to provide an attachment for resting on the arms of a wire coat hanger as a pad, such attachments have had considerable deficiencies. One deficiency is that the upstanding shank was not guarded or padded to prevent it from creasing a garment. Another deficiency is that many prior art coat hanger attachments were not adequately locked onto a hanger and would fall off. The prior art is already aware of the following U.S. Pat. Nos. 2,581,631; 3,285,481; and 3,401,853.

OBJECTS OF THE INVENTION

It is an object of the present invention to provide a coat hanger pad attachment which includes a tubular collar or guard positioned about the upstanding hook support shank of the hanger to prevent creasing of clothing therefrom.

It is another object of the present invention to provide a means for locking the pad attachment and the hanger together and for preventing relative movement therebetween.

SUMMARY OF THE INVENTION

Briefly, the aforementioned and other objects of the present invention are satisfied by providing a coat hanger attachment which includes a tubular collar for reception about the hook support shank and the upper portions of the upwardly converging arms of the hanger. A substantially rigid elongated skirt means projects integrally downward from the collar and is proportioned to cover the hanger arms along the majority of their lengths.

The hanger is captured in the attachment by a removable pin which passes diametrically through the collar. The pin passes between the upper portions of the hanger arms and adjacent the point of intersection of the arms.

For preventing the hanger from twisting relative to the attachment, a pair of planar spaced apart parallel webs are provided formed in the collar for reception of the shank and the upper portions of the arms therebetween. The pin also passes perpendicularly through the webs.

Other objects, features and advantages of the present invention will become apparent upon perusal of the following detailed description of the preferred embodiment thereof when taken in conjunction with the appended drawing wherein:

DETAILED DESCRIPTION

Figure 1:
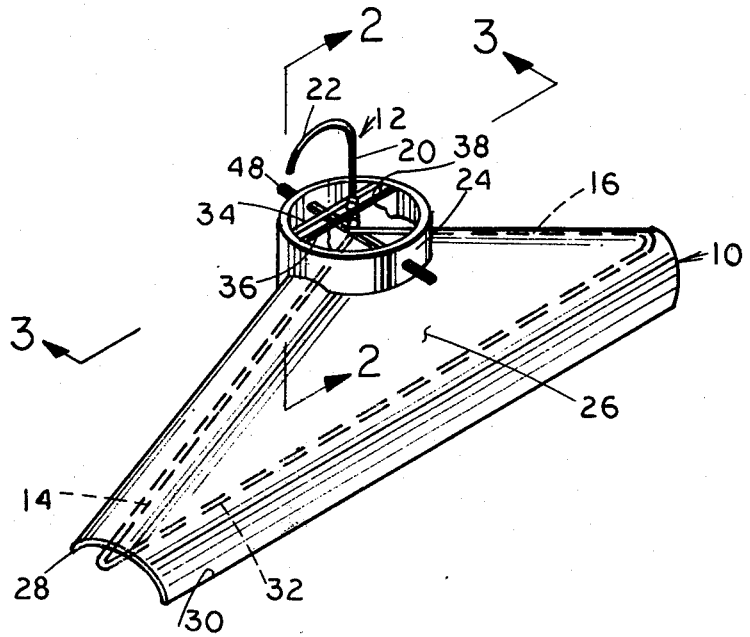
FIG. 1 is a pictorial view, partially broken away, showing the attachment of the present invention as installed on a coat hanger.
Figure 2:
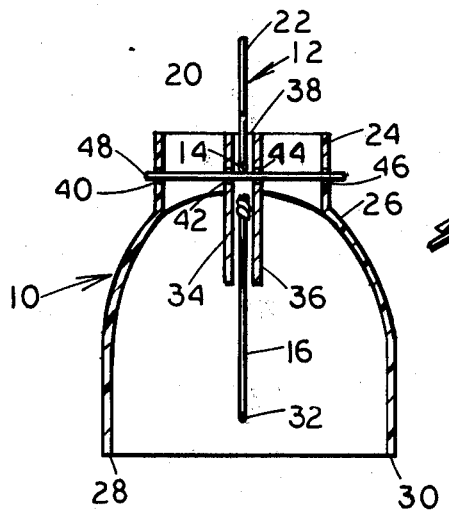
FIG. 2 is a side elevational cross-sectional view taken along the lines 2—2 in FIG. 1.
Figure 3:
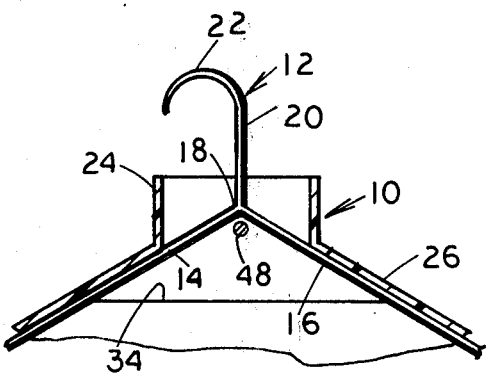
FIG. 3 is a front elevational partial cross-sectional view taken along the lines 3—3 in FIG. 1.

Referring to FIGS. 1 through 3 of the drawing the coat hanger attachment of the present invention is generally indicated by the reference numeral 10. The attachment 10 is configured to cooperate with the usual wire coat hanger 12 of the type that includes a pair of upwardly converging generally co-planar arms 14 and 16 which merge at a point of inersection 18 into a generally vertical upwardly projecting shank 20 having a hook 22 at its upper end.

Because of the relatively small cross-section of arms 14, 16 and shank 20 these areas of the hanger 12 tend to crease a garment, such as a jacket, supported on the hanger. Accordingly, the attachment 10, which is preferably a one-piece, substantially rigid plastic molded body is configured to overlie the arms 14, 16 and to surround the shank 20 to provide relatively large radii of curvature for contact with the garment.

The attachment 10 includes a tubular collar 24 of approximately four inches in diameter for substantially coaxially surrounding shank 20 and also surrounding the upper portions of the arm 14, 16. Projecting downward and outward integrally from collar 24 is a rigid skirt 26 of substantially constant wall thickness. The skirt 26 has an arcuate cross-section overlying arms 14, 16 and is configured to cover the arm along the majority of their lengths. Additionally, the skirt 26 when viewed from the side, as in FIG. 2, is rather bell shaped and extends downward with substantially straight elongated bottom margins, 28 and 30 (see FIG. 1) which are parallel to but spaced transversely from and below the horizontal rung 32 of hanger 12. It will be appreciated that skirt 26 supports an article of clothing, such as a jacket, hung thereon in spaced relationship from an article of clothing hung over rung 32, such as pants.

In view of the relatively large size of the attachment 10 relative to hanger 12, it is necessary to provide guides in the attachment to prevent the hanger from twisting relative thereto. To this end, a pair of generally planar, parallel, spaced-apart webs 34, 36 are provided directly generally diametrically within collar 24. The webs 34, 36 define a narrow throat 38 therebetween for reception of the hook 22 therethrough. The webs 34, 36 are spaced sufficiently close together to coact with the upper portions of arms 14, 16 to prevent twisting of hanger 12 about a vertical axis.

To lock the hanger 12 and attachment 10 together, aligned holes 40, 42, 44 and 46 are provided in opposite sides of collar 24 and in the webs 34, 36 to enable a removable pin 48 to be passed diametrically through the collar and perpendicularly through the webs.

The pin 48 is located between the upper portions of hanger arms 14, 16 and is positioned adjacent the point 18 of intersection of the arms to capture the hanger 12 in attachment 10.

While the preferred embodiment of the present invention has been described and illustrated in specific detail, it should be understood that numerous modifications, additions and omissions in the details thereof are possible within the intended spirit and scope of the invention claimed herein.

What is claimed is:

1. A pad attachment for a coat hanger having a pair of upwardly converging generally coplanar arms merging at a point of intersection into an upwardly projecting shank carrying a hook means at its upper end, said attachment comprising: a tubular collar for reception about said shank and the upper portions of said arms; a substantially rigid elongated skirt means projecting integrally downward from said collar and configured for covering said arms along the majority of their lengths; and a pin removably passing diametrically through said collar, and said pin being positioned to be located between the upper portions of said arms and adjacent the point of intersection of said arms for capturing said hanger in said attachment; a pair of spaced apart generally parallel planar webs integrally formed within said collar, said webs being positioned for receiving said shank and the upper portions of said arms therebetween, said webs being spaced for preventing said hanger from twisting relative to said attachment; said removably mounted pin passing generally perpendicularly through said webs.

* * * * *